United States Patent [19]

Buchert

[11] Patent Number: 4,993,443

[45] Date of Patent: Feb. 19, 1991

[54] SEWER PIPE CLEANING ACCESSORY

[75] Inventor: Phillip S. Buchert, Crystal Lake, Ill.

[73] Assignee: City of Crystal Lake, Crystal Lake, Ill.

[21] Appl. No.: 594,560

[22] Filed: Mar. 29, 1984

[51] Int. Cl.[5] ..... B08B 3/02

[52] U.S. Cl. ..... 134/167 C; 134/176; 134/179; 137/355.2

[58] Field of Search ..... 134/104, 166 C, 167 R, 134/167 C, 176, 177; 15/302; 254/360; 137/240, 355.16, 355.19, 355.20; 239/160, 112, 196, 197

[56] References Cited

U.S. PATENT DOCUMENTS

| | | | |
|---|---|---|---|
| 1,176,518 | 3/1916 | Burns | 134/167 C |
| 1,881,302 | 10/1932 | Turney | 254/360 X |
| 1,982,590 | 11/1934 | Church et al. | 134/167 Z X |
| 2,098,525 | 11/1937 | Smith | 134/167 C X |
| 2,210,934 | 8/1940 | Gleason | 239/113 |
| 2,334,207 | 11/1943 | Lamberton | 254/360 |
| 2,568,929 | 9/1951 | Palm | 242/86 X |
| 3,165,109 | 1/1965 | Hammelmann | 134/167 C |
| 3,321,184 | 5/1967 | Goss | 134/167 C X |
| 3,525,112 | 8/1970 | Masters | 134/167 Z X |
| 3,628,728 | 12/1971 | Polutnik et al. | 239/199 X |
| 3,656,694 | 4/1972 | Kirschke | 134/167 C X |
| 3,753,409 | 8/1973 | Fraizer | 239/198 X |
| 3,826,275 | 7/1974 | Courtright | 137/355.2 |
| 4,063,317 | 12/1977 | Santore | 134/166 C |
| 4,174,067 | 11/1979 | Watanabe et al. | 239/112 |
| 4,207,647 | 6/1980 | Masters | 15/302 |
| 4,232,826 | 11/1980 | Broughton | 137/355.19 X |
| 4,234,980 | 11/1980 | DiVito et al. | 15/302 |
| 4,420,852 | 12/1983 | Bowlsby | 134/166 C X |

FOREIGN PATENT DOCUMENTS

| | | | |
|---|---|---|---|
| 321603 | 1/1972 | U.S.S.R. | 134/166 C X |

*Primary Examiner*—Frankie L. Stinson

*Attorney, Agent, or Firm*—Burmeister, York, Palmatier & Zummer

[57] ABSTRACT

A sewer cleaning apparatus having a movable vehicle provided with a hose which is adapted to be fed into a sewer and provided with a nozzle having a back spray for transporting the hose along the sewer. The hose is mounted at its end opposite the nozzle on a reel mounted on the vehicle and the vehicle contains means for rotating the reel to wind the hose back onto the reel. A second hose is connected to the first hose and extends to a remote source of water pressure such as a second vehicle having a water reservoir and a high pressure pump.

4 Claims, 3 Drawing Sheets

SEWER PIPE CLEANING ACCESSORY

The present invention relates to sewer pipe cleaning apparatus, and particularly to accessories for use with present day commercial sewer pipe cleaning apparatus.

Underground sewer systems conventionally use sewer pipes which are periodically interrupted by a catch basin, that is, an underground tank having an opening for receiving sewage from one underground pipeline and a second opening for conducting sewage from the catch basin. The catch basin generally is somewhat deeper than the pipelines permitting solid debris to settle in the catch basin. Such catch basins also provide access to the sewer pipes under the surface of the ground, and if a sewer pipe becomes clogged from debris, the sewer line may be rodded from the catch basin.

Specialized equipment has been developed for opening sewer lines. U.S. Pat. No. 3,658,589 of Shaddock entitled CATCH BASIN AND SEWER PIPE CLEANER discloses a vehicle which is provided with a water reservoir, a high pressure pump, a reel on the front of the vehicle, and a hose mounted on the reel and extendable therefrom. The hose has a nozzle with a rounded forward surface or dome, and the nozzle is provided with apertures to provide a jet stream directed backward toward the hose. To open a pipe clogged with debris, the vehicle is driven to position the hose reel over a manhole cover, the hose is withdrawn from the cover until the nozzle can be inserted into the pipe to be opened, and thereafter high pressure water from the pump of the vehicle is applied to the hose and nozzle. The spray of water from the nozzle against the walls of the pipe forces the nozzle forwardly, thereby withdrawing additional hose from the reel on the vehicle. When the nozzle reaches the debris causing the blockage of the pipe, it abuts the debris tending to break up the debris and open the pipe. If the nozzle is stopped by the debris, then the hose is retracted by winding it partially upon the reel and the process is repeated until the nozzle breaks through the debris.

Vehicles such as disclosed in the aforementioned patent also are generally provided with vacuum systems for cleaning the catch basin. U.S. Pat. No. 4,134,174 of Flynn and Wuster entitled SEWER AND CATCH BASIN CLEANER, and U.S. Pat. No. 4,199,837 of Fisco, J. R. entitled APPARATUS FOR SEWER CLEANING AND THE LIKE are other examples of equipment for cleaning catch basins and breaking up debris in sewer pipes.

One difficulty that is encountered in using sewer pipe cleaners of the type described above is that catch basins are often located away from hard roads, and the relatively heavy vehicles required to handle the equipment of such sewer pipe cleaners cannot be brought to the mouth of the catch basin. Vehicles which contain pressurized sources of water require large pumps and large internal combustion engines to drive those pumps in order to produce sufficient water pressure to propel the hose down the sewer pipe, the water pressure being conventionally of the order of 2,000 to 3,000 lbs. per square inch. The conventional practice is to leave such vehicles resting on a hard road, and to route the hose from the vehicle across land to the opening of the catch basin and the sewer pipe. This not only extends the length of the hose, but it also reduces the force that the hose can exert upon debris clogging a sewer pipe. In order for the hose to be propelled forward, the hose must be dragged across the terrain from the vehicle and the resistance of the terrain impedes the force that the nozzle can exert on the debris blockage in a sewer pipe. Further, the fact that the nozzle pulls the hose forward across the terrain tends to damage vegetation on the terrain, thus making this procedure undesirable for use in residential neighborhoods where the catch basin is located at the rear of a lot and the hose must extend from the vehicle across the lot to the catch basin. Further, the hose can only be retracted by rotating the hose reel on the vehicle, thus pulling the hose back across the terrain, through the catch basin, and through the sewer pipe.

The inventor has overcome the deficiencies and disadvantages of sewer cleaning apparatus described above by providing a portable cart which contains a reel for the hose and a device for retracting the hose and rewinding the hose onto the reel. Accordingly, the sewer cleaning vehicle, or any other source of pressurized water such as a pumper can be left on hard road, the hose from the pumper extended across the terrain to the portable cart, and the process of opening the sewer pipe conducted from the mouth of the catch basin, even though that catch basis is remote from the hard road. Damage to vegetation between the portable cart and the pumper is minimized by the fact that the hose extending across this portion of the terrain is stationary, all movement occurring between the reel of the portable cart and the nozzle of the hose. Since the portable cart does not contain the pressurized source of water, that is, the internal combustion engine and the pump, the weight of these heavy elements need not be borne by the portable cart. Accordingly, the portable cart may be manually moved into position adjacent to the mouth of the catch basin.

The objects and advantages of the present invention will be more readily understood from the following specification, particularly with reference to the drawings, in which.

Figure 1:
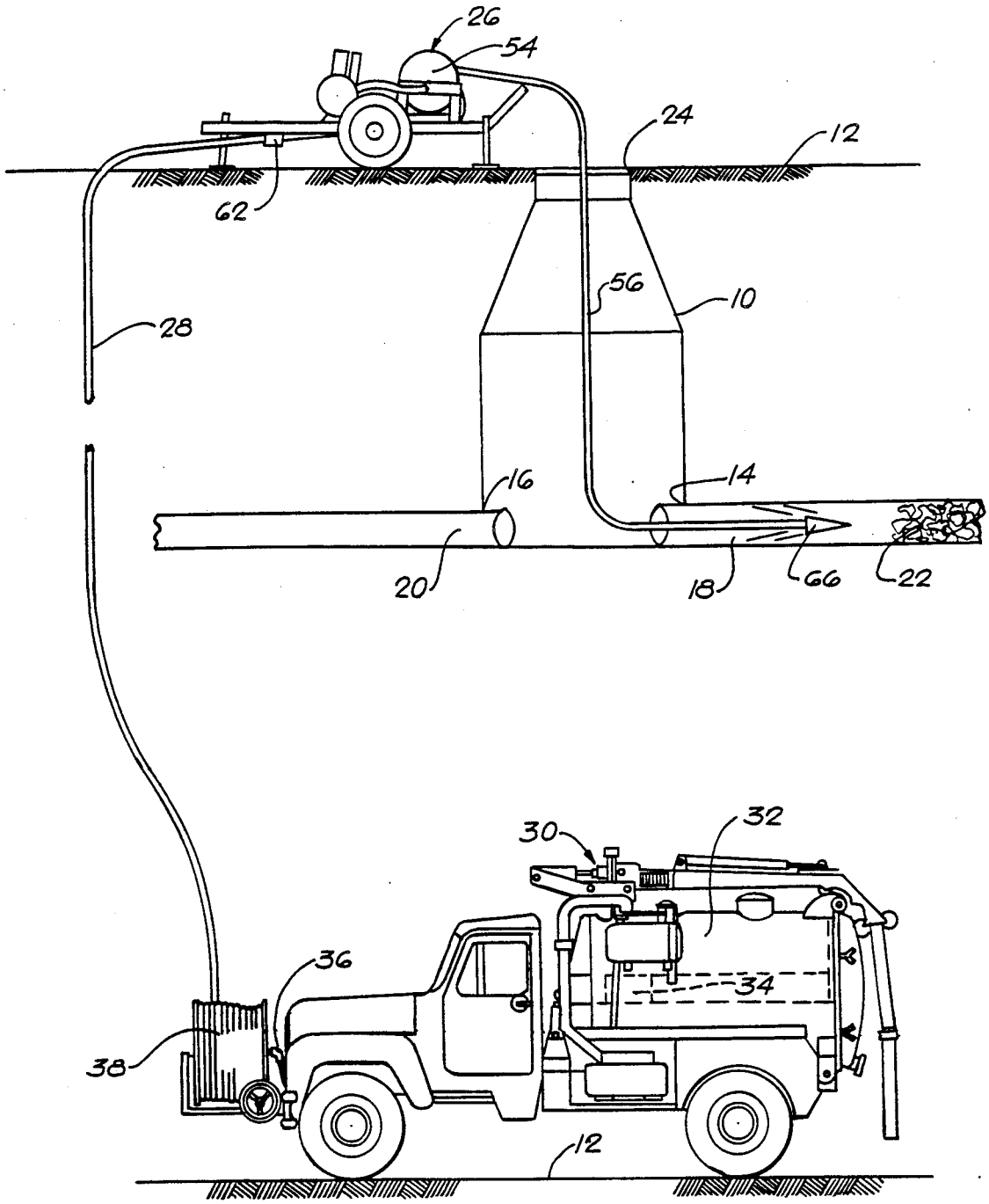
FIG. 1 is a diagrammatic view, partly in elevation and partly in section, illustrating the present invention.

FIG. 1 illustrates a typical manhole 10 which extends downwardly from ground level 12 and has two openings 14 and 16 on opposite sides thereof which communicate with conventional sewer pipes 18 and 20. As illustrated, one of the sewer pipes 18 is obstructed by a mass of debris 22. The manhole 10 is illustrated with a mouth 24 at ground level, the conventional cover having been removed.

FIG. 1 also illustrates a portable sewer cleaning accessory 26 constructed in the manner of the present invention positioned adjacent to the mouth 24 of the manhole 10. The accessory is connected by a stationary hose 28 to a pumping vehicle 30 such as a conventional sewer pipe cleaner. The vehicle 30 has a tank 32 containing water to be used in the sewer cleaning operation, and a high pressure pump 34 is connected to the tank 32 to pressurize water. A water carrying tubular support 36 is connected to the tank 34, and carries a reel 38 for the hose 28. The end of the hose 28 on the reel 38 is connected to the tubular support, thereby conducting high pressure water from the pump 34 to the hose 28. The reel 38 is unwound merely sufficiently to permit the hose 28 to reach the manhole mouth 24.

Figure 2:
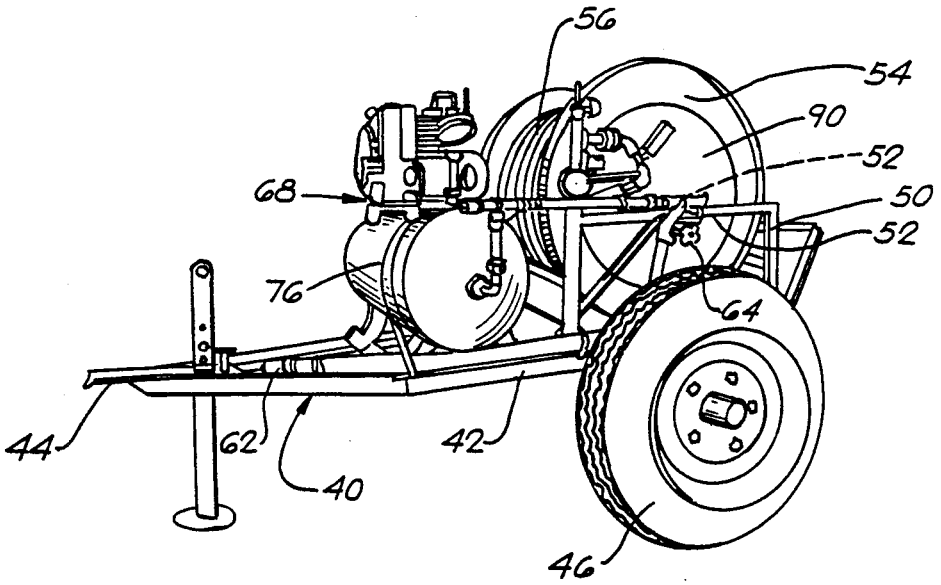
FIG. 2 is a side elevational view of the sewer pipe cleaning accessory illustrated in FIG. 1.
Figure 3:
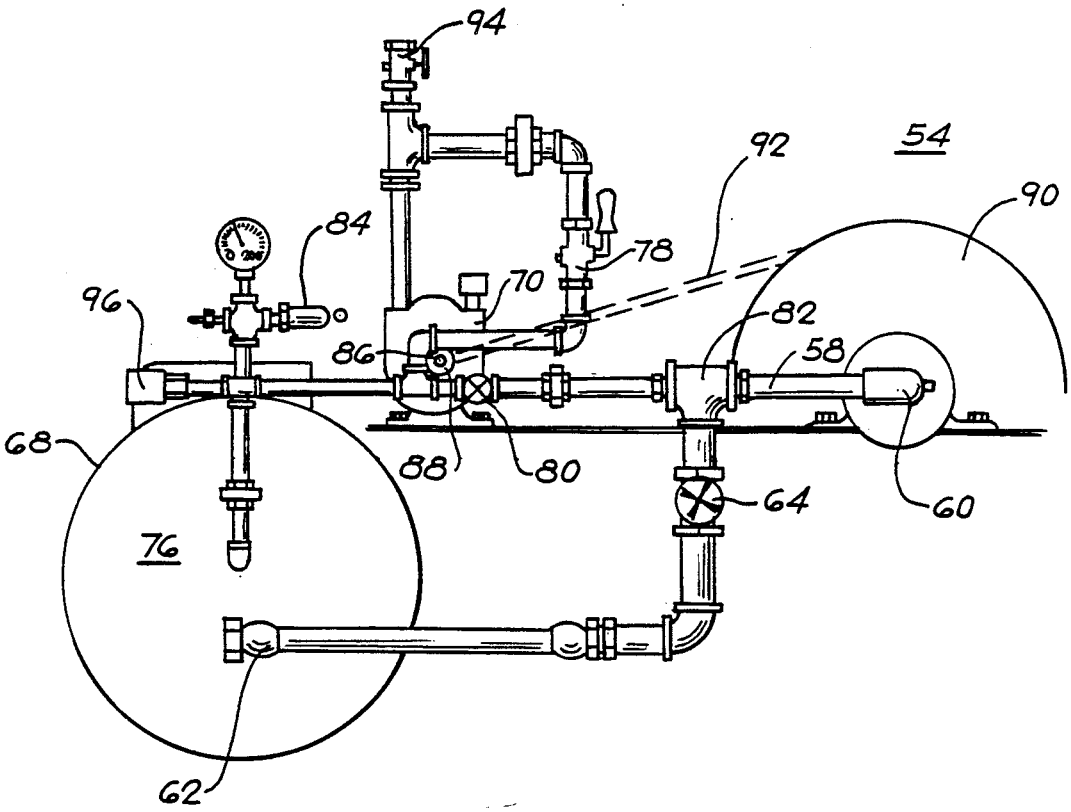
FIG. 3 is a diagrammatic view illustrating the water and air pipe systems of the sewer cleaning accessory of FIGS. 1 and 2.
Figure 4:
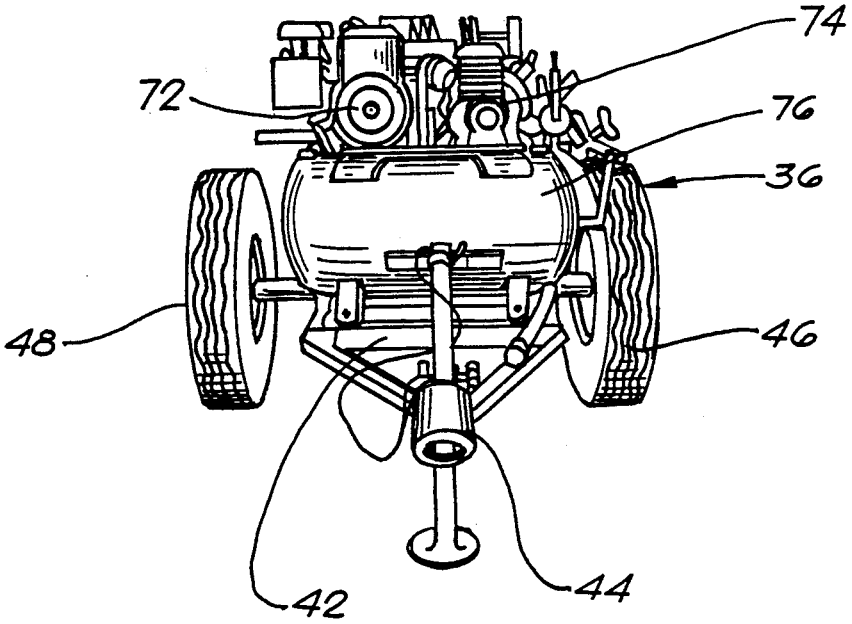
FIG. 4 is a front elevational view of the sewer cleaning accessory.

The sewer cleaning accessory 26 is best illustrated in FIGS. 2 and 4, and has a frame 40 with a rectangular portion 42 extending to a tongue 44. The tongue 44 is adapted to connect the portable sewer cleaning accessory to the trailer hitch of a truck or the like, although the sewer cleaning accessory may be manually moved into position on a pair of wheels 46 and 48 rotatably mounted on the rectangular portion 42 of the frame 40.

A pair of brackets 50 extend upwardly from the rectangular portion 42 of the frame and support a tubular axle 52 which extends across the rectangular portion of the frame. The tubular axle 52 is mounted for rotation with respect to the brackets 50 and the frame 40, and a reel 54 is mounted on the axle 52. A high pressure water hose 56 is mounted on the reel 54, and the inner end of the hose 58 is connected to the tubular axle 52.

The tubular axle 52 is connected to a pipe 58 through a rotary connector 60, and the pipe 58 is connected to a connector 62 through a valve 64. The connector 62 forms a disengageable connection with the end of the hose 28 from the vehicle 30. As a result, pressurized water from the vehicle 30 is connected to the hose 56 through the reel 54. The end of the hose 56 opposite the reel 54 carries a jet nozzle 66 which is designed to spray water backwardly on the hose 56 and against the walls of the sewer pipe 18 as indicated.

When it is desired to move the nozzle 66 down the pipe 18, the pump 34 of the vehicle 30 is placed in operation, and pressurized water will flow into the hose 28. The valve 64 is opened, thus permitting pressurized water to flow through the connectors 62, the pipe 58, the rotary connector 60 and into the hose 56. As a result of the spray from the nozzle 66, the hose 56 will travel along the sewer pipe 18, the reel 54 unwinding and providing additional length of hose to allow penetration into the sewer pipe 18. When the nozzle strikes the obstruction 22, the obstruction may be dislodged, thus opening the sewer pipe 18. If it is not dislodged, the nozzle will rest at the obstruction, and the hose will have to be retracted to make another effort at dislodging the obstruction.

The apparatus for retracting the hose is mounted on the sewer cleaning accessory 26 and comprises a source of compressed air 68 and an air motor 70 coupled to the reel 54. The source of compressed air includes a gasoline motor 72 mechanically coupled to a compressor 74 and an air tank 76. The air tank 76 is connected through a valve 78 to the air motor, and it is also connected through a second valve 80 and a T-fitting 82 to the pipe 58. A relief valve 84 is also connected to the air tank 76.

The air motor 70 has a shaft 86 which carries a gear 88, and the gear 88 is coupled to a sprocket 90 on the reel 54 by means of a chain 92.

In most cases, the weight of the water in the hose 56 so retards movement of the hose that the hose may not be retracted until that water is removed from the hose. In order to remove the water from the hose, the pump 34 from the vehicle is inactivated, and the valve 64 is closed. Thereafter, the valve 80 is opened between the compressor 68 and the reel 54, and compressed air will push the water from the hose 56 out of the jet nozzle 66. After the water has been removed from the hose 56, the valve 80 is closed, and the valve 78 opened to place the air motor 70 in operation. Rotation of the axle 86 results in rotation of the reel 54 in a direction to retract the hose 56, thus retracting the portion of the hose in the sewer pipe 18 including the nozzle. After the hose 56 has been retracted a sufficient distance, such as 6 feet, the valve 78 is closed, thus inactivating the air motor 70 and stopping retraction of the hose 56. The valve 64 may then be opened, the pump 34 on the vehicle 30 activated, and pressurized water again impressed upon the hose 56, thus causing the nozzle 66 to spray a jet of water against the walls of the sewer pipe 18 and again forcing the nozzle further into the pipe toward the obstruction 22. A bleeder valve 94 is connected between the control valve 78 and the air motor 70, and opening of the bleeder valve 94 reduces the drag of the air motor 70 when the reel 54 is being unwound.

In practice, the water pressure supplied by the pump 34 of the vehicle 30 is approximately 2,000 lbs. per square inch. The compressed air source on the sewer cleaning accessory 26 provides pressurized air at about 125 lbs. per square inch. The sewer cleaning accessory functions with the hose 56 of approximately 200 feet, and the sewer cleaning accessory 26 may be positioned from the vehicle 30 by distances up to approximately 300 feet.

The sewer cleaning accessory has other functions in connection with the maintenance of sewers. The compressed air source 68 is provided with a connector 94 for connecting any air tool to the air tank 76. Further, the sewer cleaning accessory may be utilized to position a television camera in the sewer pipe and to draw that camera through the pipe without requiring a pressurized water source, such as the vehicle 30. To do so, the hose 56 is first run through the sewer pipe 58 from the manhole 10 illustrated to the next manhole on the sewer line. At that point, the TV camera is attached to the end of the hose 56, and the hose 28 from the vehicle 30 to the auxiliary sewer cleaning apparatus 26 is removed and the vehicle can proceed to other tasks. The hose 56 is thereupon retracted and rewound on the reel 54 by utilizing the compressed air source 68 and the air motor 70 as described above.

Those skilled in the art will devise many other uses and advantages of the present invention. It is therefore intended that the scope of the present invention be not limited by the foregoing specification, but rather only by the appended claims.

The invention claimed is:

1. Apparatus for cleaning a sewer comprising a source of water pressure of sufficient quantity and under sufficient pressure to clean a sewer, and a movable vehicle disposed at a distance from the water source having a frame, a pair of parallel wheels mounted on the frame for rotation with respect thereto for supporting the frame, a water inlet mounted on the frame, said inlet being adapted to be connected to the source of water under pressure, a reel mounted on the frame for rotation with respect to the frame having a water connector, piping means connected between the water inlet and the connector including a first valve, a first hose having a central channel for transporting water under pressure having one end connected to the water connector of the reel and an opposite end, said reel being of sufficient size to contain the entire first hose in a coiled configuration, a nozzle mounted on the opposite end of the first hose, said nozzle having apertures directed back toward the hose, whereby a flow of water through the first hose and nozzle will be directed back by the nozzle to propel the first hose forward and unwind additional first hose from the reel, an air compressor mounted on the frame, an air motor mounted on the frame, means including a second valve connecting the air motor to the compressor, and a third valve connected between the compressor and the connector of the piping means, and a second hose connected at one end to the water inlet of the vehicle and connected at the other end to the source of water, said second hose being flexible and extending between the water source and the vehicle.

2. Apparatus for cleaning a sewer comprising the combination of claim 1 in combination with means for mechanically coupling the air motor and the reel.

3. Apparatus for cleaning a sewer comprising the combination of claim 1 in combination with a gasoline motor mounted on the frame and mechanically coupled to the air compressor.

4. Apparatus for cleaning a sewer comprising claim 1 in combination with a sprocket mounted on the reel for rotation therewith, a gear mounted on the air motor, and a belt extending between the sprocket and gear.

* * * * *